US006376994B1

(12) United States Patent
Ochi et al.

(10) Patent No.: US 6,376,994 B1
(45) Date of Patent: Apr. 23, 2002

(54) ORGANIC EL DEVICE DRIVING APPARATUS HAVING TEMPERATURE COMPENSATING FUNCTION

(75) Inventors: Hideo Ochi; Yoshiyuki Okuda; Masami Tsuchida, all of Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/478,526

(22) Filed: Jan. 6, 2000

(30) Foreign Application Priority Data

Jan. 22, 1999 (JP) ..... 11-014141

(51) Int. Cl.[7] ..... G09G 3/30

(52) U.S. Cl. ..... 315/169.1; 315/169.3; 345/101

(58) Field of Search ..... 315/169.1, 169.2, 315/169.3; 345/76, 78, 101

(56) References Cited

U.S. PATENT DOCUMENTS 5,594,463 A * 1/1997 Sakamoto ..... 345/76

* cited by examiner

*Primary Examiner*—David Vu
(74) *Attorney, Agent, or Firm*—Sughrue Mion, PLLC

(57) ABSTRACT

An EL device driving apparatus enables substantial light emission luminance characteristics to be kept constant even if an environmental temperature fluctuates. The apparatus includes a driving unit for selectively supplying a light emission driving energy to EL devices, a temperature sensing unit for sensing an operation temperature, and a temperature compensating unit for changing the light emission driving energy in accordance with the operation temperature.

36 Claims, 16 Drawing Sheets

ORGANIC EL DEVICE DRIVING APPARATUS HAVING TEMPERATURE COMPENSATING FUNCTION

BACKGROUND OF THE INVENTION

The present invention relates to an apparatus for driving a light emitting device and, more particularly, to a driving apparatus for an EL device.

FIELD OF THE INVENTION

Attention is paid to an EL (electroluminescence) display as a display apparatus which can be substituted for a liquid crystal display and in which a low electric power consumption, a high display quality, and a thin size can be realized. The EL display has an organic compound in which excellent light emitting performance can be expected and is used as a light emitting layer of an EL device that is used in the EL display. The device has a high efficiency and a long service life which can endure a practical use.

A full-color image display can be accomplished by selecting an organic material which can perform a light emission of red (R), green (G), or blue (B) (i.e., a first, a second, or a third primary color) as an emitting material which is applied to the light emitting layer (RGB method). It can be also accomplished by a CCM (Color Changing Mediums) method using a color converting layer for each of the RGB colors as disclosed in "Nikkei Electronics", Vol. 1.29 (No. 654), pp. 99–103, 1996, or the like.

The organic EL device (hereinafter, simply referred to as an EL device) can be expressed by an electrical equivalent circuit as shown in FIG. 1.

As will be understood from FIG. 1, the EL device can be expressed by a configuration comprising a capacitive component C and a component E having diode characteristics connected in parallel with the capacitive component. Generally, the EL device is a capacitive light emitting device.

When a light emission driving voltage is applied to the EL device, charges corresponding to a capacitance first flow to an electrode as a displacement current and are accumulated. When the voltage exceeds a certain voltage (light emission threshold voltage) that is peculiar to the device, a forward current starts to flow from an anode into an organic layer serving as a light emitting layer and light emission occurs at an intensity that is proportional to the driving current.

FIGS. 2 to 4 show light emitting characteristics (L-I, I-V, and L-V characteristics: where "L", "I", and "V" denotes a light emission luminance, a driving current, and a driving voltage, respectively) of the EL device. When the driving voltage exceeding the light emission threshold value is applied to the EL device, light emission occurs at a luminance that is proportional to the driving current in accordance with the driving voltage. When the applied driving voltage is equal to or lower than the light emission threshold value, no driving current flows and the light emission luminance is also almost equal to zero.

As a method of driving a color panel using the EL device, it is known that a simple matrix driving method can be applied. A driving method of performing a resetting operation to discharge accumulated charges in each EL device arranged in a matrix form just before scanning lines are switched (hereinafter, referred to as a reset driving method) has been disclosed in Japanese Laid-Open Patent Publication (Kokai) No.H09-199136 (1997) by the same applicant as that of the present invention. The reset driving method will now be described with reference to FIGS. 5 to 8.

EL devices $E_{1,1}$ to $E_{n,m}$ serving as pixels are arranged in a matrix form. One end (anode side of the diode component E of the equivalent circuit) of each EL device is connected to an anode line and the other end (cathode side of the diode component E) is connected to a cathode line at each intersecting position between anode lines $A_1$ to $A_n$ arranged along the vertical direction and cathode lines $B_1$ to $B_m$ arranged along the horizontal direction, respectively.

A cathode line scanning circuit 1 and an anode line driving circuit 2 are provided as light emission driving means for the EL device. The cathode line scanning circuit 1 has a function to individually decide an electric potential of each cathode line in order to select a cathode line to be scanned. In more detail, scan switches $\mathbf{5}_1$ to $\mathbf{5}_m$ corresponding to the cathode lines $B_1$ to $B_m$ connect either a reverse bias voltage $V_B$ (for example, 10V) or a ground potential (0V) to the corresponding cathode lines.

The anode line driving circuit 2 has a function to individually supply a driving current through each anode line. In more detail, current sources $\mathbf{2}_1$ to $\mathbf{2}_n$ are provided in correspondence to the anode lines $A_1$ to $A_n$. Currents which are generated in the current sources flow individually to the anode lines $A_1$ to $A_n$ through drive switches $\mathbf{6}_1$ to $\mathbf{6}_n$.

The anode lines $A_1$ to $A_n$ are also connected to an anode resetting circuit 3. The anode resetting circuit 3 has shunt switches $\mathbf{7}_1$ to $\mathbf{7}_n$ each provided every anode line. When the shunt switch is turned on, the corresponding anode line is connected to the ground potential.

Each of the cathode line scanning circuit 1, the anode line driving circuit 2 and the anode resetting circuit 3 is controlled by a light emission control circuit 4. The light emission control circuit 4 controls each circuit in order to display an image carried by image data in accordance with an image data signal supplied from an image data generating system (not shown).

That is, the light emission control circuit 4 generates a scanning line selection control signal to the cathode line scanning circuit 1, selects any of the cathode lines $B_1$ to $B_m$ corresponding to a horizontal scanning period of the image data, and connects it to the ground potential. The control circuit 4 switches the scan switches $\mathbf{5}_1$ to $\mathbf{5}_m$ so that the reverse bias voltage $V_B$ is applied to the other cathode lines. The scan switches $\mathbf{5}_1$ to $\mathbf{5}_m$ are, therefore, subjected to a switching control according to what in called a-line-at-a-time scanning such that they are sequentially switched to the ground potential every horizontal scanning period. The cathode line connected to the ground potential acts as a scanning line for enabling the EL devices connected to the cathode line to perform a light emission.

The anode line driving circuit 2 performs a light emission control to the scanning line that is being scanned. The light emission control circuit 4 generates a drive control signal (driving pulse) indicating a result of a discrimination with respect to which one of the EL devices connected to the scanning line is allowed to perform the light emission at which timing for which duration in accordance with image information of the image data. The light emission control circuit 4 supplies the generated control signal to the anode line driving circuit 2.

The anode line driving circuit 2 controls the on/off operations of the drive switches $\mathbf{6}_1$ to $\mathbf{6}_n$ in response to the control signal and supplies the driving current to the EL device in accordance with the pixel information through the anode lines $A_1$ to $A_n$. The EL device to which the driving current is supplied, thus, performs a light emission according to the pixel information.

The anode resetting circuit 3 is provided to perform the resetting operation. The resetting operation is performed in response to the reset control signal from the light emission control circuit 4. The anode resetting circuit 3 turns on any of the shunt switches $\mathbf{7}_1$ to $\mathbf{7}_n$ corresponding to the reset target anode line indicated by the reset control signal and turns off the other switches. The operation of a reset driving method based on the above configuration will now be described.

An operation flow will be explained as an example hereinbelow where after the cathode line $B_1$ is scanned and the EL devices $E_{1,1}$ and $E_{2,1}$ are allowed to emit the light, the scan is shifted to the cathode line $B_2$ and the EL devices $E_{2,2}$ and $E_{3,2}$ are allowed to emit the light. For simplicity of explanation, the EL device which performs the light emission is shown by a diode symbol and the EL device which does not perform the light emission is shown by a capacitor symbol. The reverse bias voltage $V_B$ which is applied to the cathode lines $B_1$ to $B_m$ is set to the same voltage 10V as a power voltage of the apparatus.

First, in FIG. 5, the scan switch $\mathbf{5}_1$ is switched to the 0V position as a reference voltage and the cathode line $B_1$ is scanned. The reverse bias voltage 10V as a predetermined voltage is applied to the other cathode lines $B_2$ to $B_m$ via the scan switches $\mathbf{5}_2$ to $\mathbf{5}_m$.

The current sources $\mathbf{2}_1$ and $\mathbf{2}_2$ are connected to the anode lines $A_1$ to $A_2$ via the drive switches $\mathbf{6}_1$ and $\mathbf{6}_2$. The other anode lines $A_3$ to $A_n$ are connected to the ground potential 0V via the shunt switches $\mathbf{7}_3$ to $\mathbf{7}_n$.

In case of FIG. 5, therefore, only the EL devices $E_{1,1}$ and $E_{2,1}$ are biased in the forward direction, the driving currents flow from the current sources $\mathbf{2}_1$ and $\mathbf{2}_2$ as shown by arrows, and only the EL devices $E_{1,1}$ and $E_{2,1}$ emit the light. In FIG. 5, each of the EL devices shown by hatched regions in the capacitors is charged to a polarity as shown in the diagram. The following reset control is performed just before the scan is shifted from the light emitting state shown in FIG. 5 to a state where the light emission of the EL devices $E_{2,2}$ and $E_{3,2}$ as shown in FIG. 8 is performed.

That is, before the scan target is shifted from the cathode line $B_1$ in FIG. 5 to the cathode line $B_2$ in FIG. 8, first, as shown in FIG. 6, all of the drive switches $\mathbf{6}_1$ to $\mathbf{6}_n$ are turned off, all of the scan switches $\mathbf{5}_1$ to $\mathbf{5}_m$ and all of the shunt switches $\mathbf{7}_1$ to $\mathbf{7}_n$ are switched to the 0V position, and all of the anode lines $A_1$ to $A_n$ and cathode lines $B_1$ to $B_m$ are once set to 0V (all-resetting operation by 0V). Since all of the anode lines and the cathode lines are set to the same electric potential of 0V in the all-resetting operation by the voltage of 0V, the electrical charges charged in each EL device pass through the routes as shown by the arrows in the diagram and are discharged. The electrical charges charged in all of the EL devices instantaneously become to 0.

After the charged charges in all of the EL devices are become to 0 this manner, by switching only the scan switch $\mathbf{5}_2$ corresponding to the cathode line $B_2$ to the 0V position as shown in FIG. 7, the cathode line $B_2$ is scanned. At the same time, the current sources $\mathbf{2}_2$ and $\mathbf{2}_3$ are connected to the corresponding anode lines by the drive switches $\mathbf{6}_2$ and $\mathbf{6}_3$, the shunt switches $\mathbf{7}_1$ and $\mathbf{7}_4$ to $\mathbf{7}_n$ are turned on, and the anode lines $A_1$ and $A_4$ to $A_n$ are connected to 0V.

When the cathode line $B_2$ is scanned through the switching operation of the switches and the charged charges in all of the EL devices are set to 0 as mentioned above, the charging currents flow to the EL devices $E_{2,2}$ and $E_{3,2}$ to be subsequently subjected to the light emission via a plurality of routes as shown by the arrows in FIG. 7. A capacitor C of each EL device is instantaneously charged.

That is, not only the charging current flows to the EL device $E_{2,2}$ through the route of (the current source $\mathbf{2}_2$→drive switch $\mathbf{6}_2$→anode line $A_2$→EL device $E_{2,2}$→scan switch $\mathbf{5}_2$) but also the charging current simultaneously flows through the route of (the scan switch $\mathbf{5}_1$→cathode line $B_1$→EL device $E_{2,1}$→EL device $E_{2,2}$→scan switch $\mathbf{5}_2$) the route of (the scan switch $\mathbf{5}_3$→cathode line $B_3$→EL device $E_{2,3}$→EL device $E_{2,2}$→scan switch $\mathbf{5}_2$), . . . , and the route of (the scan switch $\mathbf{5}_m$→cathode line $B_m$→EL device $E_{2,m}$→EL device $E_{2,2}$→scan switch $\mathbf{5}_2$). Since the EL device $E_{2,2}$ is instantaneously charged up to the light emission threshold value with large charging current through those plural routes, it can be momentarily shifted to a stationary state of the light emission shown in FIG. 8.

Since the EL device $E_{3,2}$ is also instantaneously charged up to the light emission threshold value with the charging currents by those plural routes as shown in FIG. 7, it can be momentarily shifted to a stationary state of the light emission shown in FIG. 8.

As mentioned above, according to the reset driving method, since all of the cathode lines and anode lines are once connected to 0V as a ground potential and are reset before the control is shifted to the light emission control mode for the next scanning line, when the scanning line is switched to the next scanning line, the EL devices to be subjected to the light emission on the switched scanning line are quickly charged up to the light emission threshold value. Thus, rapid increase of the light emission of the devices can be realized.

Although the EL devices other than the EL devices $E_{2,2}$ and $E_{3,2}$ to be subjected to the light emission are also charged through the routes as shown by the arrows in FIG. 7, since the charging direction in this instance is the reverse bias direction, the EL devices other than the EL devices $E_{2,2}$ and $E_{3,2}$ do not cause an erroneous light emission.

Although the case of using the current sources $\mathbf{2}_1$ to $\mathbf{2}_n$ as driving sources has been mentioned in the examples of FIGS. 5 to 8, the above driving method can be similarly realized by using voltage sources.

Further, a Japanese Laid-Open Patent Publication (Kokai) No.H09-232074 (1997) discloses that the reset driving method can be realized not only by the all-resetting operation of the EL devices by 0V as mentioned above but also by another predetermined reset voltage or by resetting the necessary EL devices.

In the state just after the switching of the scanning line shown in FIG. 7, a voltage of about $V_B$ [V] (in the example, 10V) which will be a value enough for the light emission threshold value is applied to the EL devices $E_{2,2}$ and $E_{3,2}$ to be subjected to the light emission and they are instantaneously charged by the flow of the current from the reverse bias voltage source, thereby preparing so that they can perform the light emission immediately after the drive switches $\mathbf{6}_2$ and $\mathbf{6}_3$ are turned on.

The light emission control including the above-mentioned preparation will now be described. FIG. 9 shows the light emission control mode by the reset driving method described above and the driving pulses which can be supplied individually as control signals to the drive switches in the anode line driving circuit 2 in correspondence to the mode.

As shown in FIG. 9, the light emission control mode includes a scanning mode as a period of time during which any of the cathode lines $B_1$ to $B_m$ is activated and a resetting mode as a period of time during which the operation as shown in FIG. 6 is performed subsequently to the activating period. The scanning mode and the resetting mode are executed every horizontal scanning period (1H) of the image data.

While the driving pulse shows the high level in the scanning mode, one of the drive switches $6_1$ to $6_n$ corresponding to the driving pulse is turned on and the light emission of the EL device is continued. At this time, the driving current which is supplied to the EL device is constant.

The longer the period of time during which the driving pulse is at the high level, the longer the light emitting time of the EL device and light emission luminance can be increased. A bright state can be formed by increasing the width of the driving pulse, therefore, and a dark state can be formed by decreasing the driving pulse width, so that a multi-stage gradation control can be accomplished. The gradation control is executed on the basis of a PWM (pulse width modulation).

The luminance of the actual output light of the EL device which is obtained in the gradation control is as shown in FIG. 10. FIG. 10 shows a state of a change in luminance L of the output light of the EL device at the maximum gradation (designated maximum luminance) at which the driving pulse is held at the high level for a period of time in the scanning mode.

Just after the resetting, the luminance of the EL device shows a relatively steep rising state and reaches the maximum luminance by the driving of the output voltage $V_B$ from the reverse bias power source and the output current of the constant current source. The luminance immediately drops and then becomes stable at the luminance corresponding to the designated gradation only by the driving current from the constant current source. The stable light emission is maintained until the next resetting mode.

The driving by the reverse bias power source and the constant current source just after the resetting corresponds to the operation of the "preparation" mentioned above, namely, the operation of FIG. 7 and the subsequent driving only by the constant current source corresponds to the operation of FIG. 8.

According to the light emission control, the light emission of the EL device is rapidly activated by the preparing operation just after the resetting, thereby enabling the driving to be shifted smoothly to the driving only by the subsequent driving pulses from the constant current source. An area surrounded by the luminance curve in FIG. 10 and the time (t) axis corresponds to the light emission amount and the substantial luminance corresponds to the area.

It is, therefore, necessary to keep the relation between the area and one gradation (pulse width of the driving pulse) constant. Unless otherwise, it is considered that the linearity of the gradation is lost. Particularly, it is required to keep the relation constant even if the operating environment changes in terms of the display quality.

OBJECT AND SUMMARY OF THE INVENTION

The present invention is made in consideration of the foregoing drawbacks and it is an object of the invention to provide an EL device driving apparatus which enables substantial light emission luminance characteristics of the device to be kept constant even if an environmental temperature fluctuates.

According to one aspect of the present invention, there is provided an EL device driving apparatus comprising: a driving unit for selectively supplying a light emission driving energy to the EL devices; a temperature sensing unit for sensing an operation temperature of the EL devices; and a temperature compensating unit for changing the light emission driving energy in accordance with the operation temperature.

According to another aspect of the present invention, the driving unit comprises: a plurality of first electrode lines; a plurality of second electrode lines which intersect the first electrode lines; and a light emission control unit for selecting any of the first electrode lines every horizontal scanning period of an image signal that is supplied, selecting any of the second electrode lines in correspondence to a pixel position in the horizontal scanning period, applying a reverse bias voltage to portions between non-selected lines among the first electrode lines and non-selected lines among the second electrode lines, and supplying a driving current to portions between the selected electrode line among the first electrode lines and the selected electrode line among the second electrode lines, wherein the EL devices are arranged in a matrix form in which one of each of electrodes and another electrode are connected to one of the first electrode lines and one of the second electrode lines, respectively, and the temperature compensating unit changes a magnitude of the reverse bias voltage in accordance with the operation temperature.

Further, the light emission control unit has a resetting unit for performing a resetting operation to extract charges accumulated in the EL devices every the horizontal scanning period.

Still further, the temperature compensating unit decreases a magnitude of the reverse bias voltage in accordance with an increase in the operation temperature and increases the magnitude of the reverse bias voltage in accordance with a decrease in the operation temperature.

According to further aspect of the present invention, the driving unit comprises: a plurality of first electrode lines; a plurality of second electrode lines which intersect the first electrode lines; and a light emission control unit for selecting any of the first electrode lines every horizontal scanning period of an image signal that is supplied, selecting any of the second electrode lines in correspondence to a pixel position in the horizontal scanning period, applying a reverse bias voltage to portions between non-selected lines among the first electrode lines and non-selected lines among the second electrode lines, and supplying a driving current to portions between the selected electrode line among the first electrode lines and the selected electrode line among the second electrode lines, wherein the EL devices are arranged in a matrix form in which one of each of electrodes and another electrode are connected to one of the first electrode lines and one of the second electrode lines, respectively, and the temperature compensating unit changes a magnitude of the driving current in accordance with the operation temperature.

Further, the light emission control unit has a resetting unit for performing a resetting operation to extract charges accumulated in the EL devices every the horizontal scanning period.

Still further, the temperature compensating unit decreases a magnitude of the driving current in accordance with an increase in the operation temperature and increases the magnitude of the driving current in accordance with a decrease in the operation temperature.

According to still further aspect of the present invention, the driving unit comprises: a plurality of first electrode lines; a plurality of second electrode lines which intersect the first electrode lines; and a light emission control unit for selecting any of the first electrode lines every horizontal scanning period of an image signal that is supplied, selecting any of the second electrode lines in correspondence to a pixel position in the horizontal scanning period, applying a reverse bias voltage to portions between non-selected lines among the first electrode lines and non-selected lines among the second electrode lines, and supplying a driving current to portions between the selected electrode line among the first electrode lines and the selected electrode line among the second electrode lines, wherein the EL devices are arranged in a matrix form in which one of each of electrodes and another electrode are connected to one of the first electrode lines and one of the second electrode lines, respectively, and the temperature compensating unit changes a magnitude of the supplying period of time of the driving current in accordance with the operation temperature.

Further, the light emission control unit has a resetting unit for performing a resetting operation to extract charges accumulated in the EL devices every the horizontal scanning period.

Still further, the temperature compensating unit decreases the driving period of time in accordance with an increase in the operation temperature and increases the driving period of time in accordance with a decrease in the operation temperature.

Further, the temperature sensing unit includes a thermistor.

DETAILED DESCRIPTION OF THE PREFERRED EMBODIMENTS

An embodiment of the present invention will now be described in detail hereinbelow with reference to the drawings.

Figure 1:
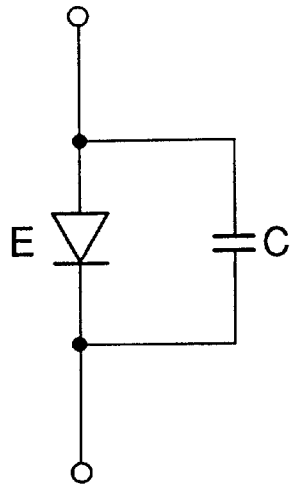
FIG. 1 is a diagram showing an equivalent circuit of an organic EL device.
Figure 2:
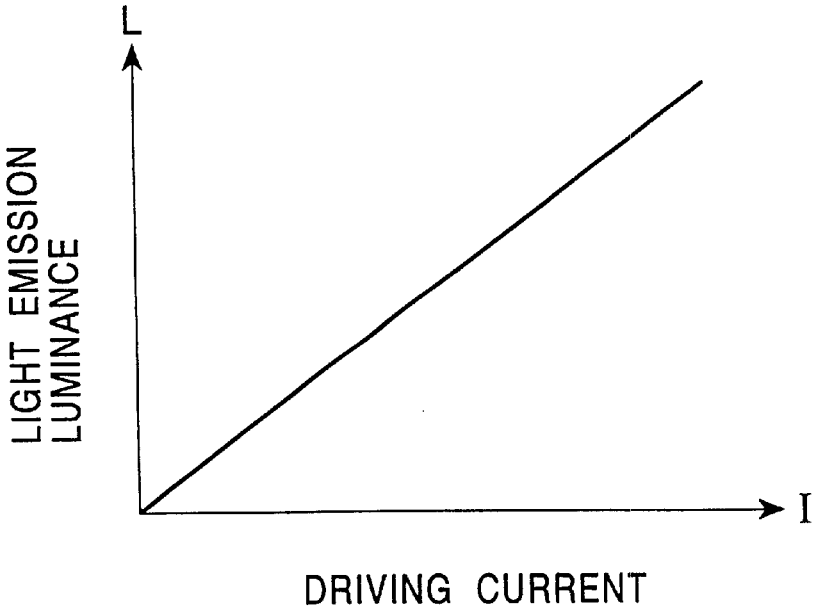
FIG. 2 is a graph schematically showing characteristics of a light emission luminance of the organic EL device versus a driving current.
Figure 3:
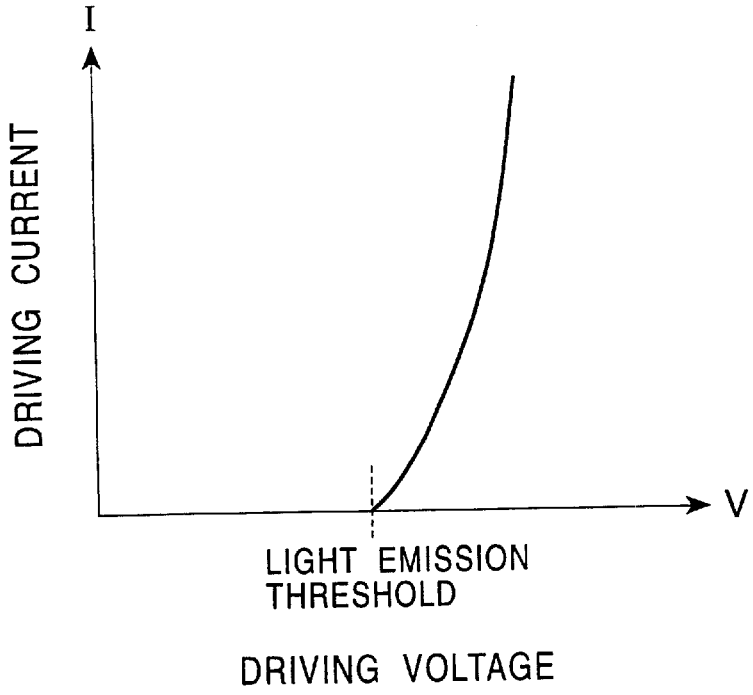
FIG. 3 is a graph schematically showing characteristics of a light emission luminance of the organic EL device versus a driving current.
Figure 4:
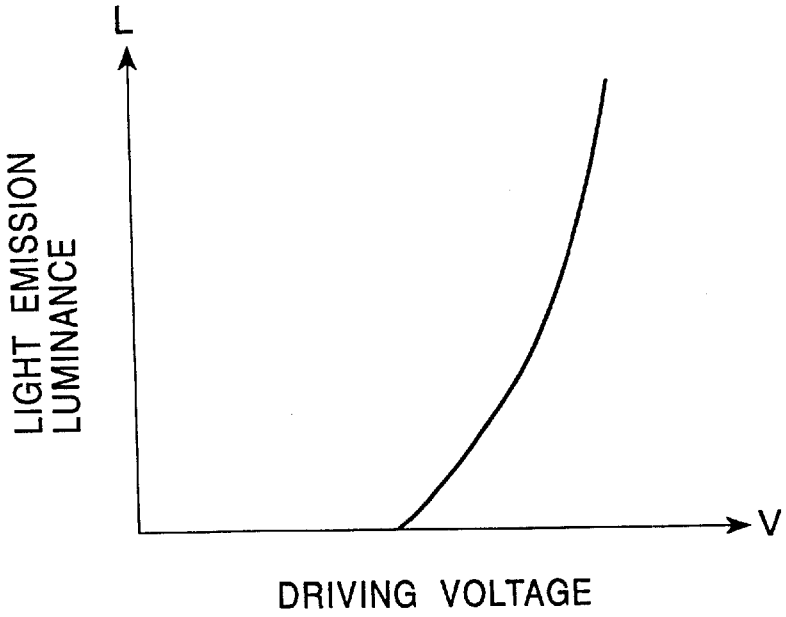
FIG. 4 is a graph schematically showing characteristics of a light emission luminance of the organic EL device versus a driving current.
Figure 5:
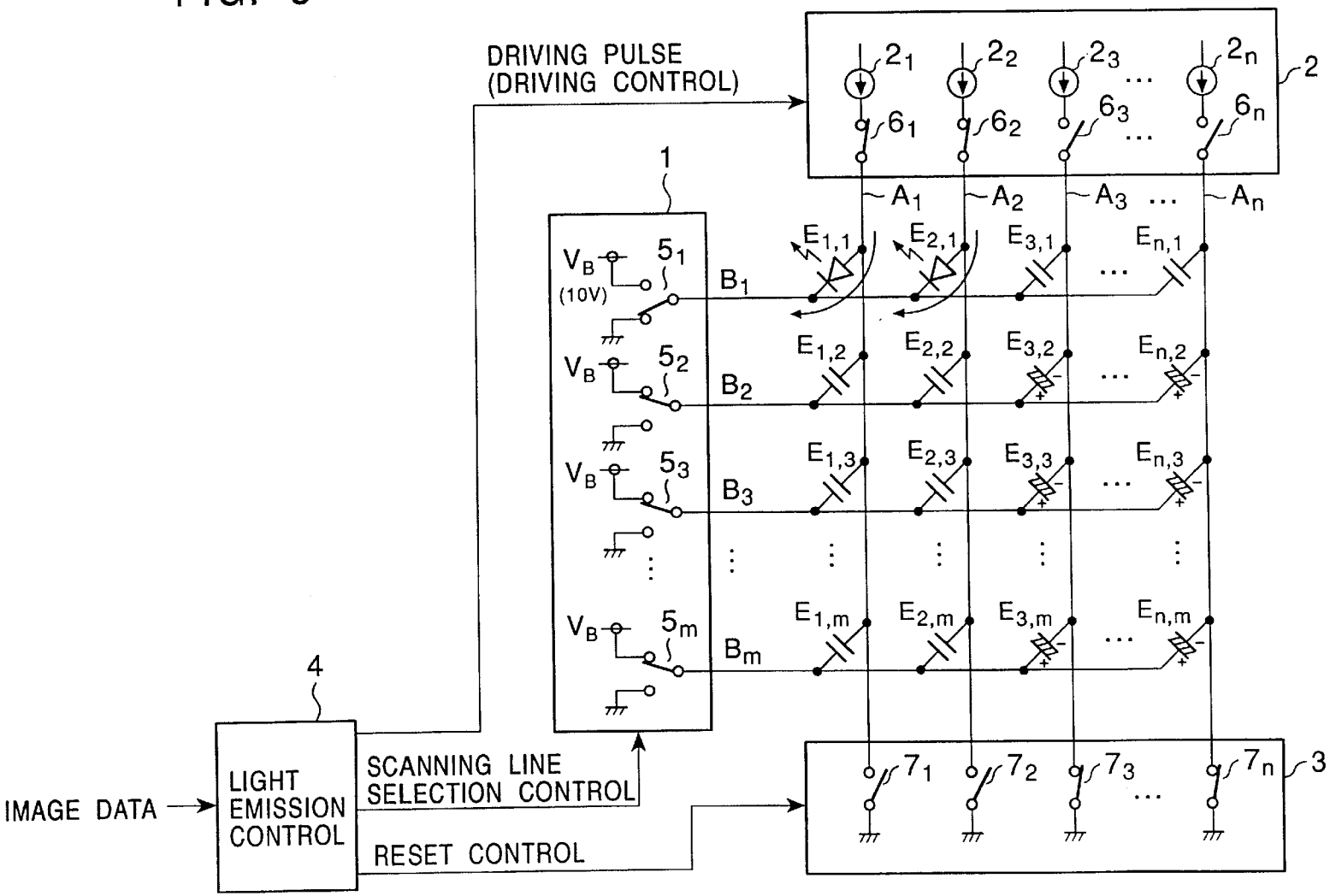
FIG. 5 is a first block diagram for explaining a configuration of a display apparatus using conventional EL devices and a reset driving method which is applied thereto.
Figure 6:
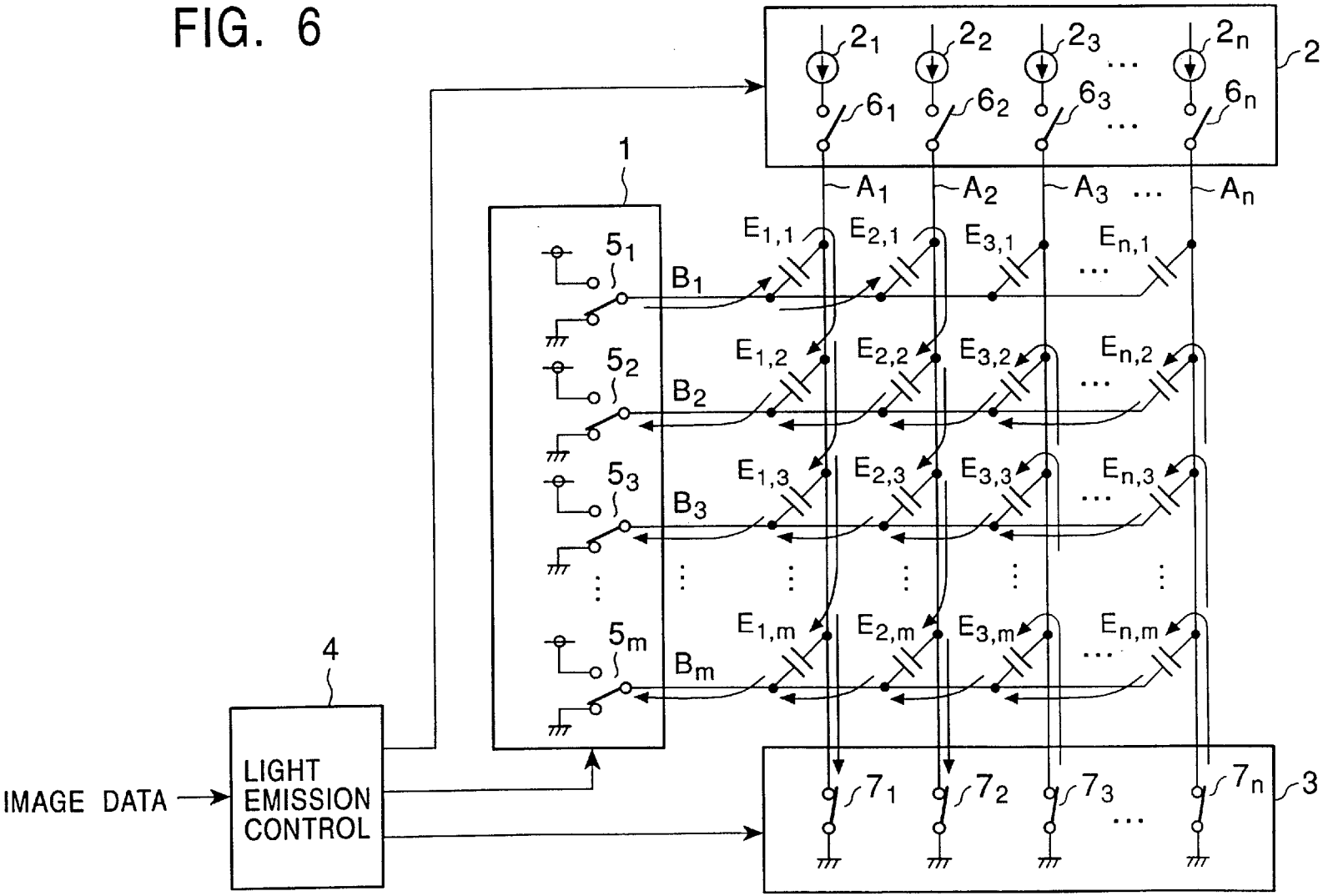
FIG. 6 is a second block diagram for explaining a configuration of a display apparatus using conventional EL devices and a reset driving method which is applied thereto.
Figure 7:
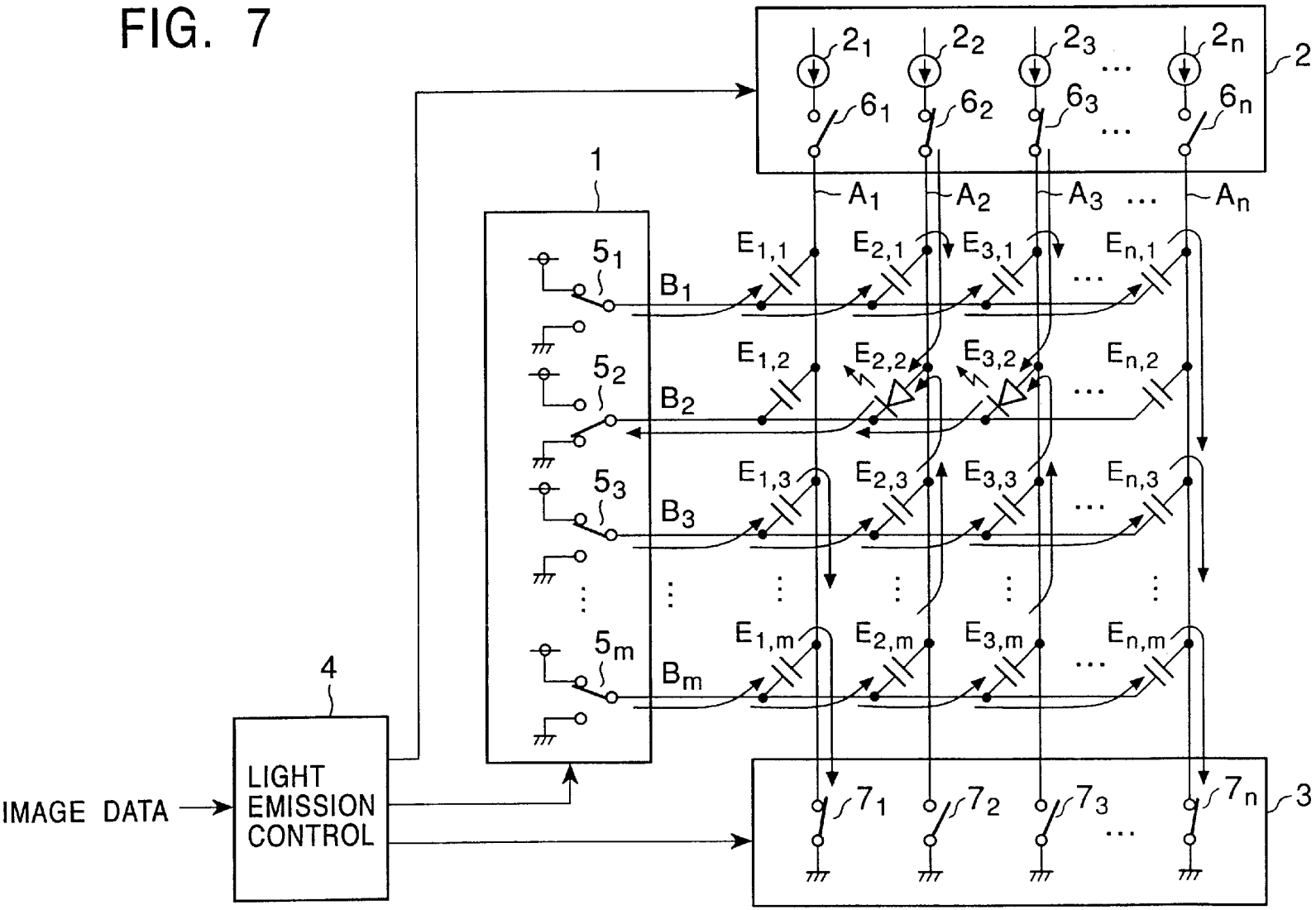
FIG. 7 is a third block diagram for explaining a configuration of a display apparatus using conventional EL devices and a reset driving method which is applied thereto.
Figure 8:
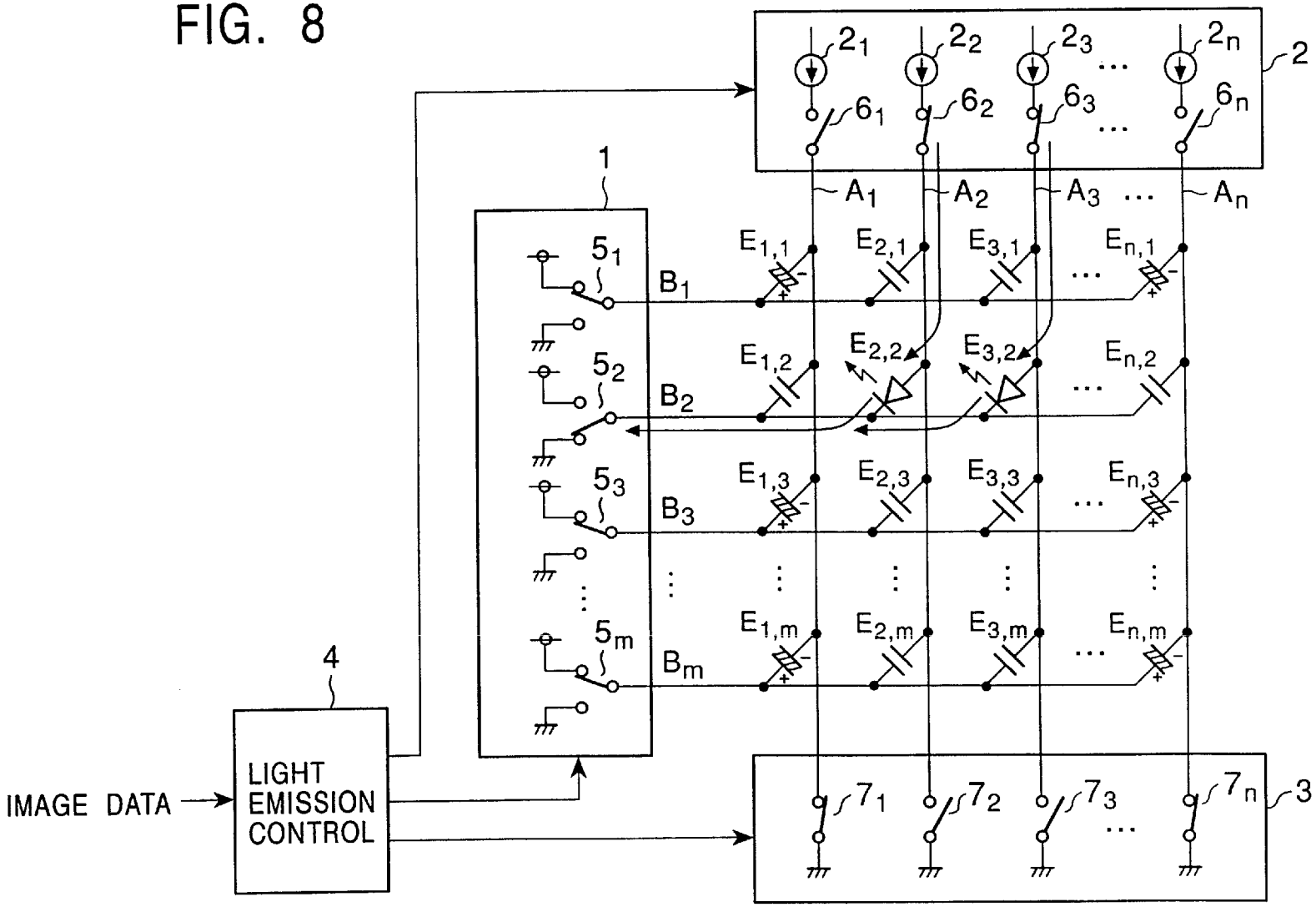
FIG. 8 is a fourth block diagram for explaining a configuration of a display apparatus using conventional EL devices and a reset driving method which is applied thereto.
Figure 9:
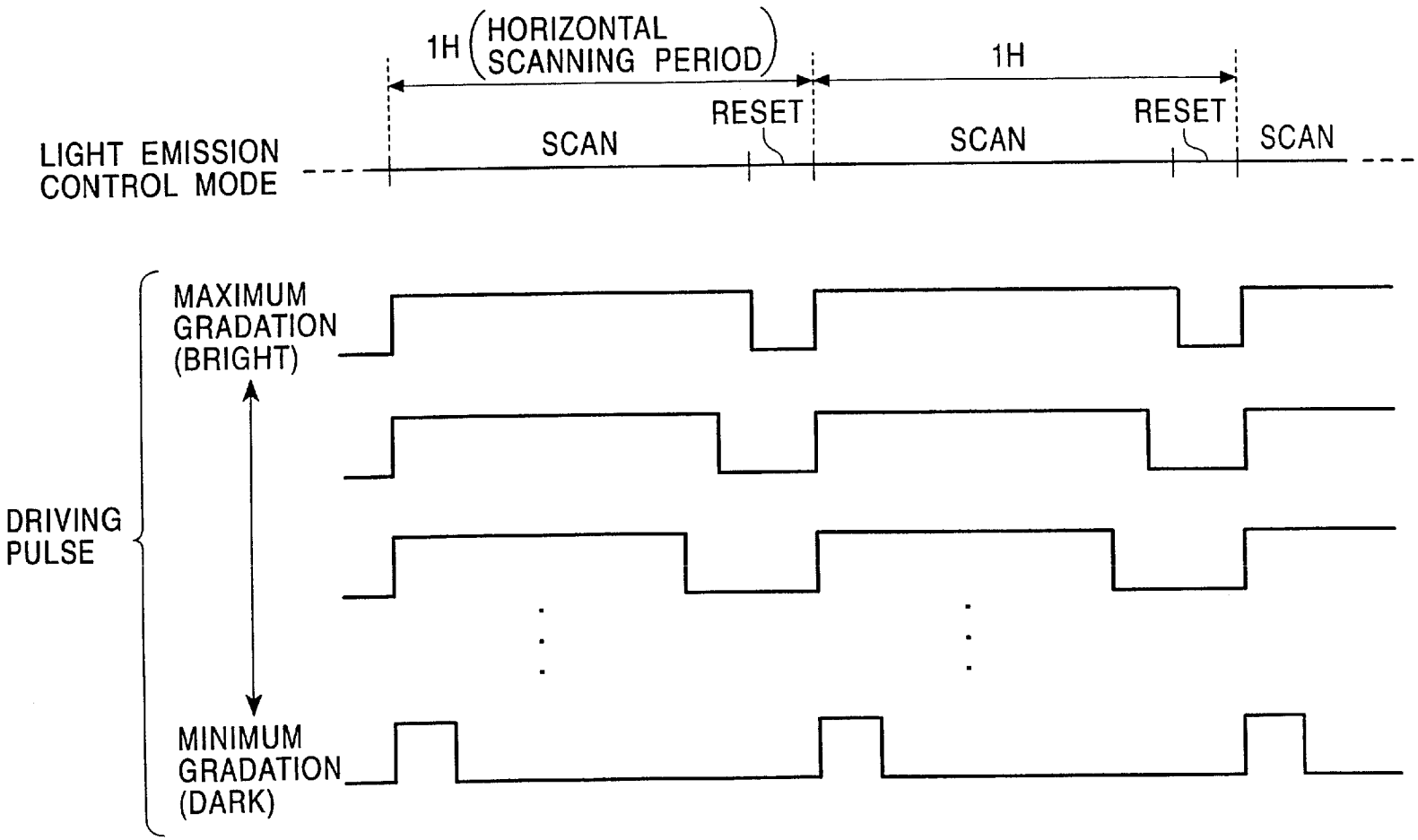
FIG. 9 is a time chart showing a state of a light emission control mode according to a reset driving method and a state of a gradation control.
Figure 10:
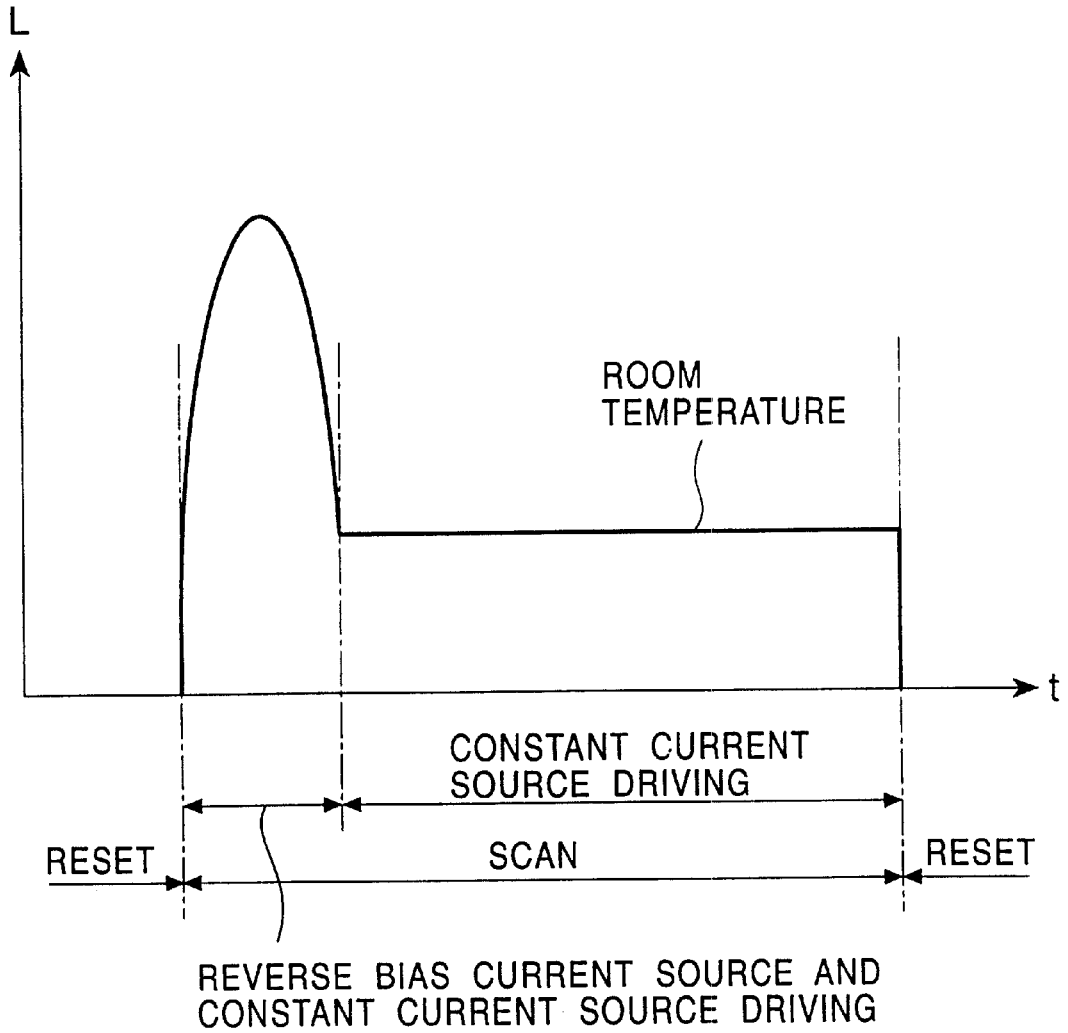
FIG. 10 is a time chart showing a state of a change in luminance L of the EL device output at the maximum gradation.
Figure 11:
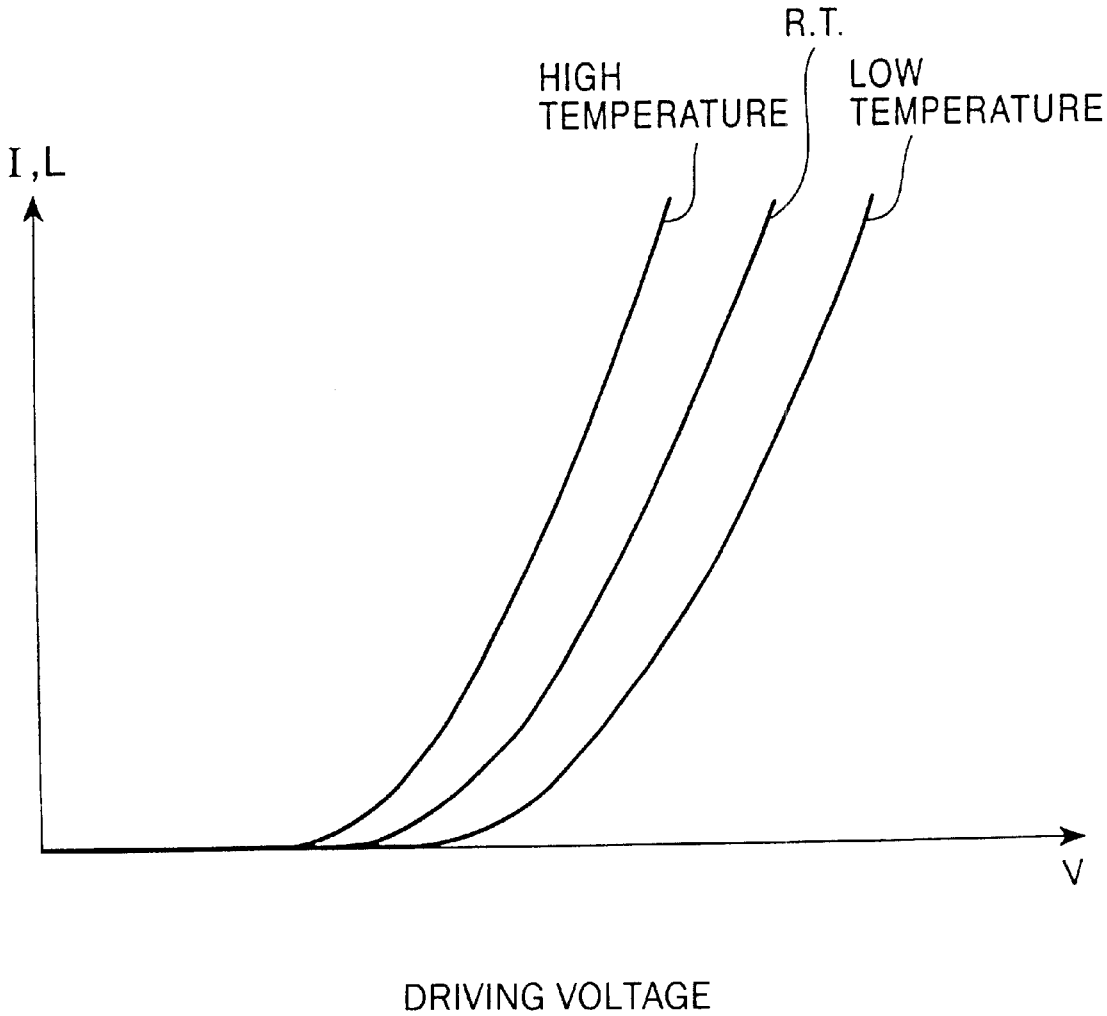
FIG. 11 is a graph showing a temperature dependence of light emission luminance characteristics of the EL device as a function of the applied voltage.

The inventors of the present invention have found that the luminance characteristics of an EL device generally change depending on temperature as shown in FIG. 11.

More particularly, the luminance characteristics of an EL device has a light emission threshold and the emission luminance L of the EL device is increased as the applied voltage V increases in a region exceeding the threshold value. Further, the threshold value decreases as the temperature increases. The EL device, therefore, has a temperature dependency in terms of the emission luminance such that the EL device emits light with a smaller applied voltage as the temperature increases, and shows a bright luminance at a higher temperature under the fixed applied voltage.

Therefore, a substantially constant light emission luminance is derived by providing a controller so that as the temperature increases (decreases), a driving energy including a driving voltage or a driving current is decreased (increased). A value of the driving current I flowing to the EL device relative to the applied voltage V also shows similar characteristics.

Various embodiments based on the nature of the EL device will now be described hereinbelow.

Figure 12:
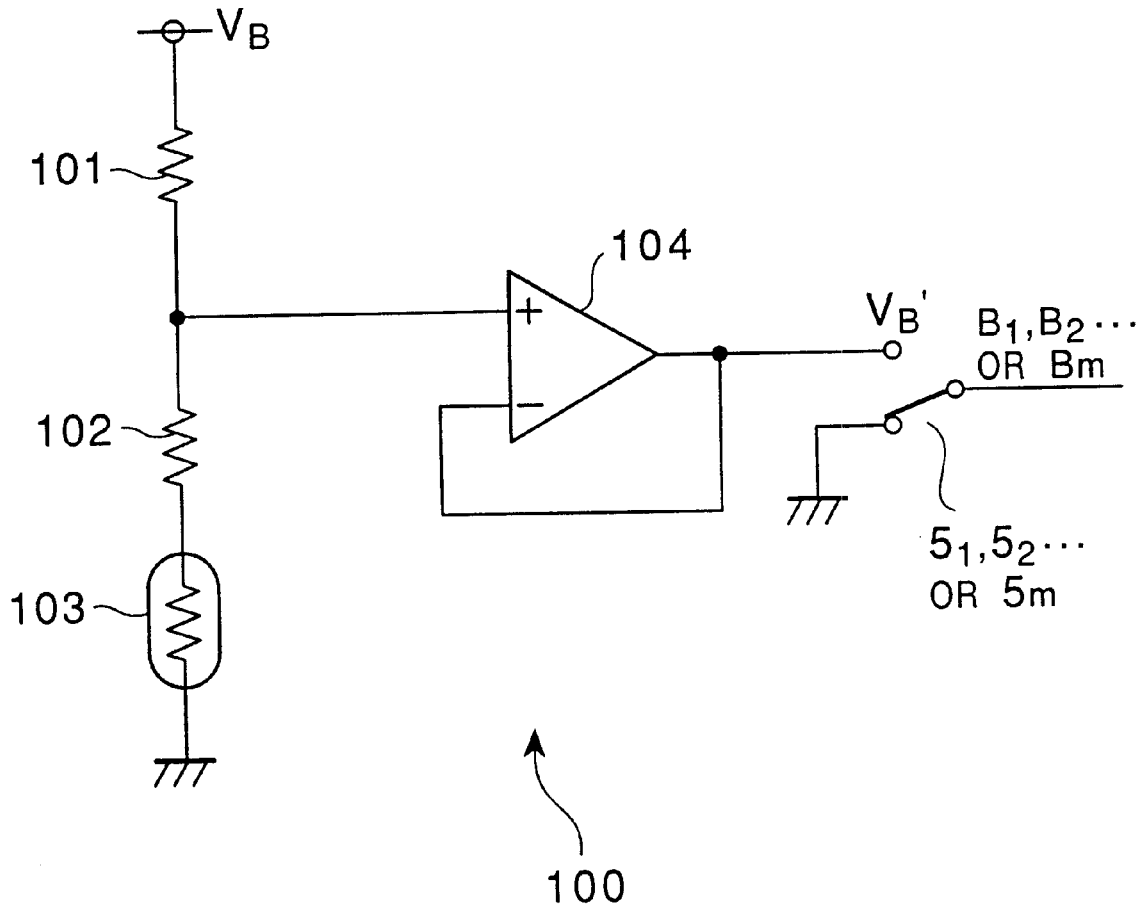
FIG. 12 is a block diagram showing a configuration of a part of an EL device driving apparatus according to an embodiment of the present invention.

FIG. 12 shows a part of a circuit configuration of an EL device driving apparatus according to an embodiment of the present invention.

The circuit is a modification of a reverse bias voltage output system of the scanning circuit 1 in a part of the EL device driving apparatus of the display apparatus shown in FIGS. 5 to 8.

As shown in FIG. 12, a reverse bias voltage $V_B'$ to be supplied to one cathode line (first electrode line or row scanning line) is not directly generated from the power voltage $V_B$ but is generated by a reverse bias generating circuit 100 having a feature of the EL device driving apparatus according to the embodiment.

The reverse bias generating circuit 100 is constructed by a resistor 101 in which one end is connected to a power source for generating the voltage $V_B$, a resistor 102 in which one end is connected to the other end of the resistor 101, a thermistor 103 in which one end is connected to the other end of the resistor 102 and the other end is connected to the ground, and an operational amplifier 104 in which a non-inverting input terminal is connected to a common connecting point of the resistors 101 and 102 and an output terminal is connected to an inverting input terminal is connected. The thermistor 103 senses the temperature. The resistors 101, 102 and the operational amplifier 104 serve as means for compensating the temperature fluctuation.

The operational amplifier 104 generates the reverse bias voltage $V_B'$ as an output of the reverse bias generating circuit 100 to supply the voltage $V_B'$ to the corresponding input terminals of the scan switches $\mathbf{5}_1$, $\mathbf{5}_2$, . . . , and $\mathbf{5}_m$. The scan switch selectively supplies the reverse bias voltage $V_B'$ or the ground potential to a corresponding one of the cathode lines $B_1$, $B_2$, . . . , and $B_m$.

The thermistor 103 changes in resistance in accordance with the temperature. Since a voltage dividing ratio between the resistance value of the resistor 101 and a total resistance of the resistor 102 and the thermistor 103 changes depending on the temperature, a voltage which is supplied to the non-inverting input terminal of the operational amplifier 104 changes in accordance with the temperature. The reverse bias voltage $V_B$ which was temperature compensated can be, consequently, supplied from the output terminals of the operational amplifier 104.

Figure 13:
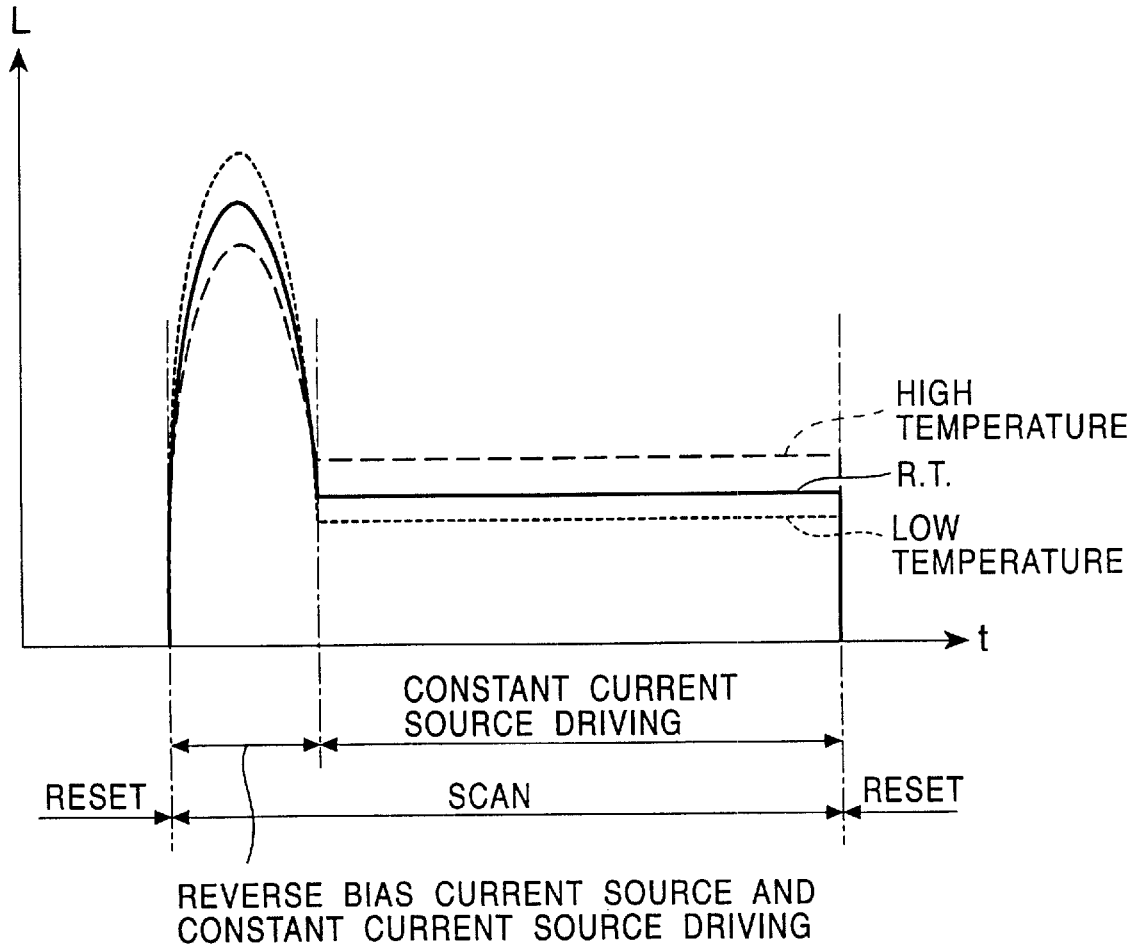
FIG. 13 is a time chart showing a change in light emission luminance of the EL device for explaining the temperature compensating operation of the driving apparatus of FIG. 12.

The relation between the area surrounded by the luminance curve and the time (t) axis and the gradation (pulse width of the driving pulse), which is based on the light emission control of the PWM mentioned above, can be maintained to be constant by the temperature compensated reverse bias voltage $V_B'$. FIG. 13 shows the details thereof.

According to FIG. 13, it will be understood that in a driving period of time by only the constant current source, the light emission luminance of the EL device is increased at a high temperature and decreased at a low temperature. The output current of the constant current source is held constant while the light emission luminance for the driving current of the EL device changes in accordance with the temperature.

The whole substantial light emission luminance in the scanning mode can be made constant by controlling the light emission luminance in a driving period of time (hereinafter, referred to as a preparing period) by the reverse bias power source and the constant current source in accordance with the change in light emission luminance in a driving period of time (hereinafter, referred to as a constant current source driving period) only by the constant current source. In more detail, since the light emission luminance in the constant current source driving period is increased at a high temperature, the reverse bias voltage $V_B'$ should be changed so as to reduce the light emission luminance by a level corresponding to the high luminance in the preparing period. Since the light emission luminance in the constant current source driving period is decreased at a low temperature, the reverse bias voltage $V_B'$ should be changed so as to increase the light emission luminance by a level corresponding to the low luminance in the preparing period. A circuit to realize the above operation by using the thermistor in the scanning circuit 1 is shown in FIG. 12.

Figure 14:
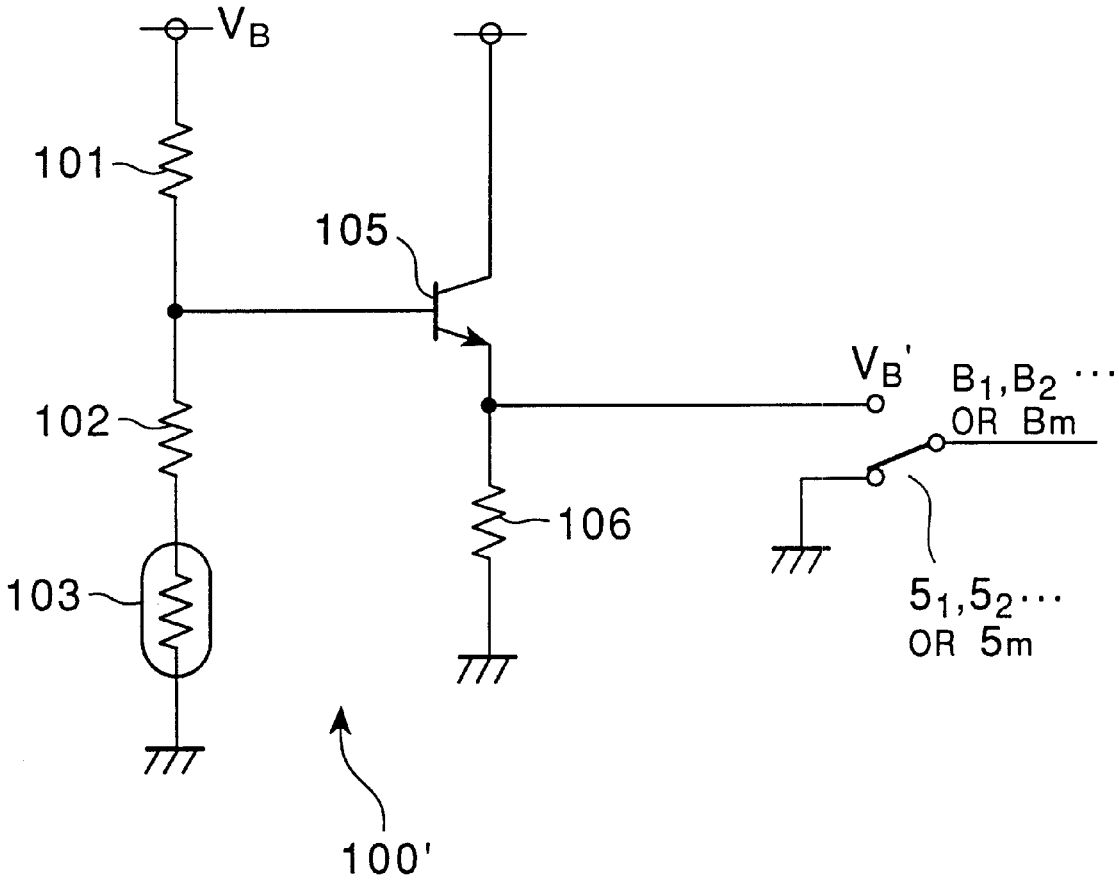
FIG. 14 is a circuit diagram showing a modification of the driving apparatus in FIG. 12.

A configuration of FIG. 12 can be modified to a configuration as shown in FIG. 14. In FIG. 14, a PNP transistor 105 is used in place of the operational amplifier 104 to realize a reverse bias generating circuit 100'. A current is supplied to a collector of the transistor 105 and its emitter is connected to the ground through a resistor 106. The temperature compensated reverse bias voltage $V_B'$ is obtained from the emitter of the transistor 105 in a manner similar to the aforementioned embodiment.

Figure 15:
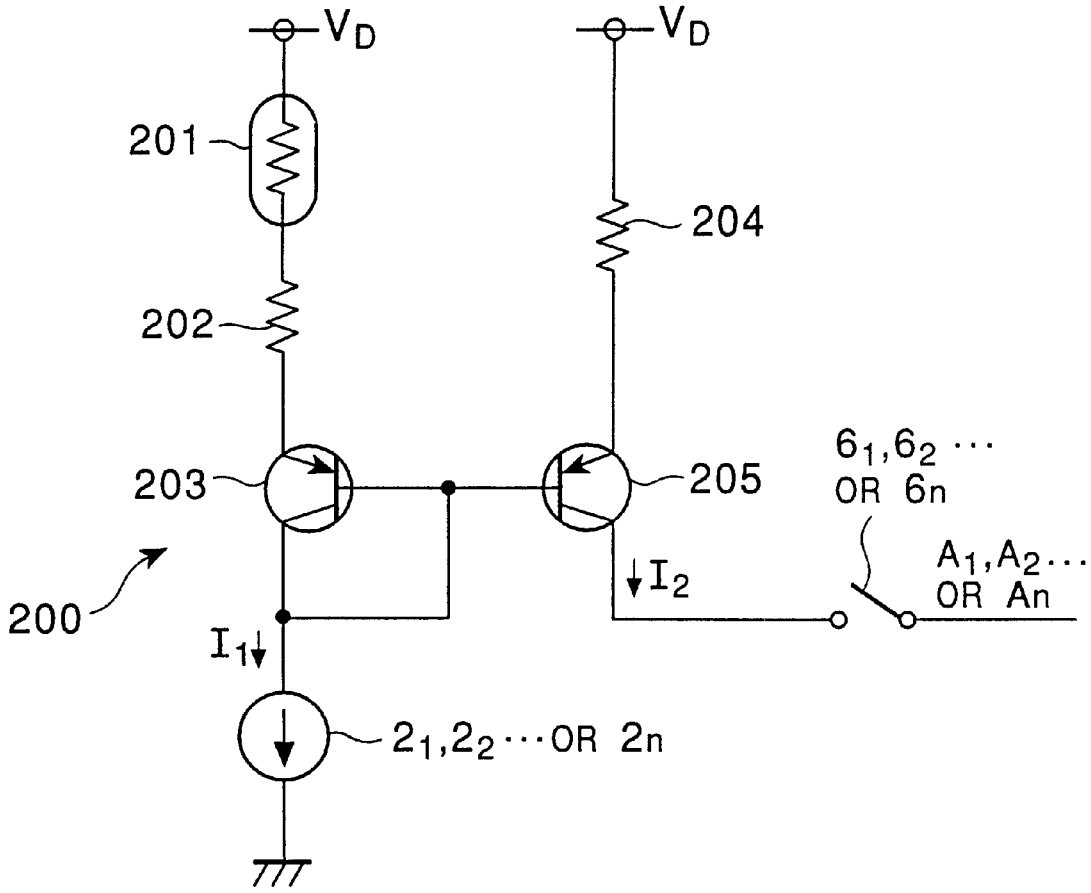
FIG. 15 is a block diagram showing a configuration of a part of an EL device driving apparatus according to another embodiment of the present invention.

In the aforementioned embodiment, the temperature compensation is performed by controlling the reverse bias voltage. The temperature compensation, however, can be also performed by controlling the output current of the constant current source according to a configuration as shown in FIG. 15. The embodiment shown in FIG. 15 is an example of a modified constant current circuit of the driving circuit 2 as a part of the driving unit of the EL device in the display apparatuses as shown in FIGS. 5 to 8.

In FIG. 15, a current generating circuit 200 controls the current from the constant current source $\mathbf{2}_1$, $\mathbf{2}_2$, . . . , or $\mathbf{2}_n$ in accordance with the operation temperature and generates a temperature compensated current.

The current generating circuit 200 is what is called a current mirror circuit. The current generating circuit 200 is constructed by: a thermistor 201 in which one end is connected to the power source; a resistor 202 in which one end is connected to the other end of the thermistor 201; a PNP transistor 203 in which an emitter is connected to the other end of the resistor 202, a collector is connected to the ground through the constant current source $\mathbf{2}_1$, $\mathbf{2}_2$, . . . , or $\mathbf{2}_n$, and a base and the collector are connected; and a PNP transistor 205 in which a current is supplied to an emitter through a resistor 204 and a base is connected to the base of the transistor 203. The collector of the transistor 205 is led out as a current output terminal to the drive switch $\mathbf{6}_1$, $\mathbf{6}_2$, . . . , or $\mathbf{6}_n$. The driving current is, therefore, supplied to the anode lines $A_1$ to $A_n$ as second electrode lines (or column data lines) not directly from the constant current source but through the current generating circuit 200.

The thermistor 201 is an example of the temperature sensing unit and the portions except for the drive switches $\mathbf{6}_1$ to $\mathbf{6}_n$ are examples of the temperature compensating unit.

The sum of resistance values of the thermistor 201 and the resistor 202 is equal to a resistance value of the resistor 204 at a reference temperature. Electrical characteristics of the transistors 203 and 205 are equalized and the circuit shown in FIG. 15 properly operates as a current mirror circuit.

According to the above-mentioned configuration, since the thermistor 201 changes in resistance value in accordance with the temperature, an emitter voltage of the transistor 203 changes and a current $I_1$ flowing to the constant current source also changes in accordance with the temperature. In association with the operation, a current $I_2$ flowing to the collector of the transistor 205 changes so as to have the same value as that of the current $I_1$, so that the temperature compensated driving current is supplied to the anode line through the drive switch.

Figure 16:
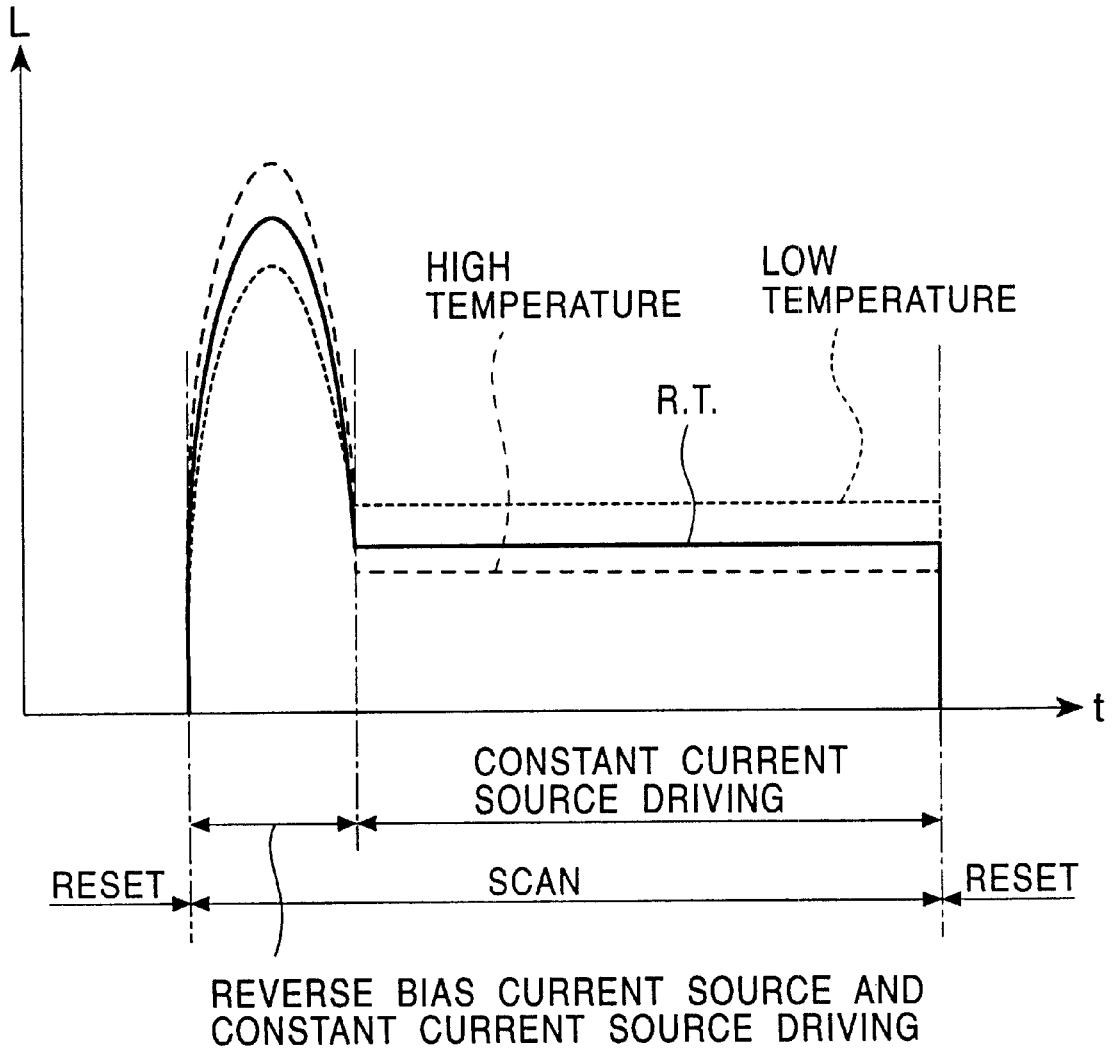
FIG. 16 is a time chart showing a change in light emission luminance of the EL device for explaining the temperature compensating operation of the driving apparatus of FIG. 15.

The relation between the area surrounded by the luminance curve and the time (t) axis and the gradation (pulse width of the driving pulse), which is based on the light emission control of the PWM mentioned above, can be maintained to be constant by the temperature compensated driving current. FIG. 16 shows the details thereof.

According to FIG. 16, in the preparing period, the light emission luminance of the EL device is low at a low temperature and high at a high temperature. The reverse bias voltage is held constant and the light emission luminance of the EL device depends on the temperature and changes in accordance with the applied voltage in the preparing period.

The whole substantial light emission luminance in the scanning mode can be made constant by controlling the light emission luminance in the constant current source driving period in accordance with the change in light emission luminance in the preparing period. In more detail, since the light emission luminance in the preparing period is high at a high temperature, the driving current is changed so as to reduce the light emission luminance in the constant current source driving period by a level corresponding to the low luminance. Since the light emission luminance in the preparing period is low at a low temperature, the driving current is changed so as to raise the light emission luminance in the constant current source driving period by a level corresponding to the high luminance. The temperature compensation is realized by a circuit using the thermistor in the driving circuit 2 shown in FIG. 15.

Figure 17:
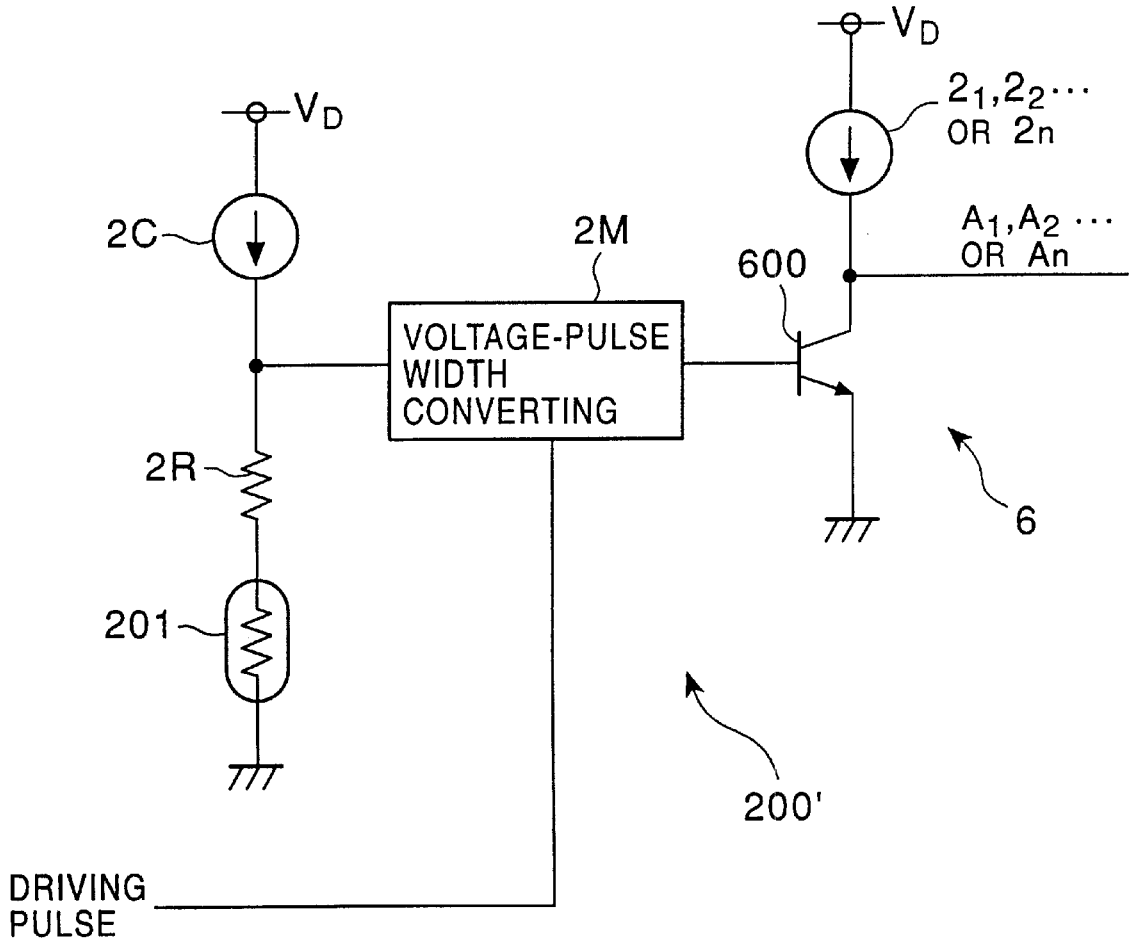
FIG. 17 is a block diagram showing a configuration of a part of an EL device driving apparatus according to further another embodiment of the present invention.

Although the temperature compensation is performed by controlling the driving current in the above-mentioned embodiments, the temperature compensation can be also performed by controlling a supplying duration of the driving current to the anode line by a configuration as shown in FIG. 17.

A current generating circuit 200' in FIG. 17 has a voltage-pulse width converting circuit 2M and the converting circuit changes a pulse width of the driving pulse from the light emission control circuit 4 (refer to FIGS. 5 to 8) in accordance with the temperature.

In more detail, a constant current source 2C which is driven by a power voltage $V_D$ is provided for each anode line independently of the constant current sources $\mathbf{2}_1$, $\mathbf{2}_2$, . . . , and $\mathbf{2}_n$, and a resistor 2R and the thermistor 201 are sequentially serially connected between the constant current source 2C and a ground point. A common connecting node of the constant current source 2C and resistor 2R is connected to the voltage-pulse width converting circuit 2M. A control voltage, therefore, according to the resistance change due to the temperature of the thermistor 201 is supplied to the voltage-pulse width converting circuit 2M.

The voltage-pulse width converting circuit 2M changes the pulse width of the driving pulse in accordance with the control voltage. The pulse width changed driving pulse is supplied to a base of an NPN transistor 600 whose emitter is connected to the ground.

The transistor 600 functions as drive switches $\mathbf{6}_1$ to $\mathbf{6}_n$ as shown in FIGS. 5 to 8 and on/off controls a collector current from the constant current source $\mathbf{2}_1$, $\mathbf{2}_2$, . . . , or $\mathbf{2}^n$ in response to the input driving pulse to the base. The temperature compensated modified PWM driving current pulse, thus, is supplied from an output of the current generating circuit 200'.

Figure 18:
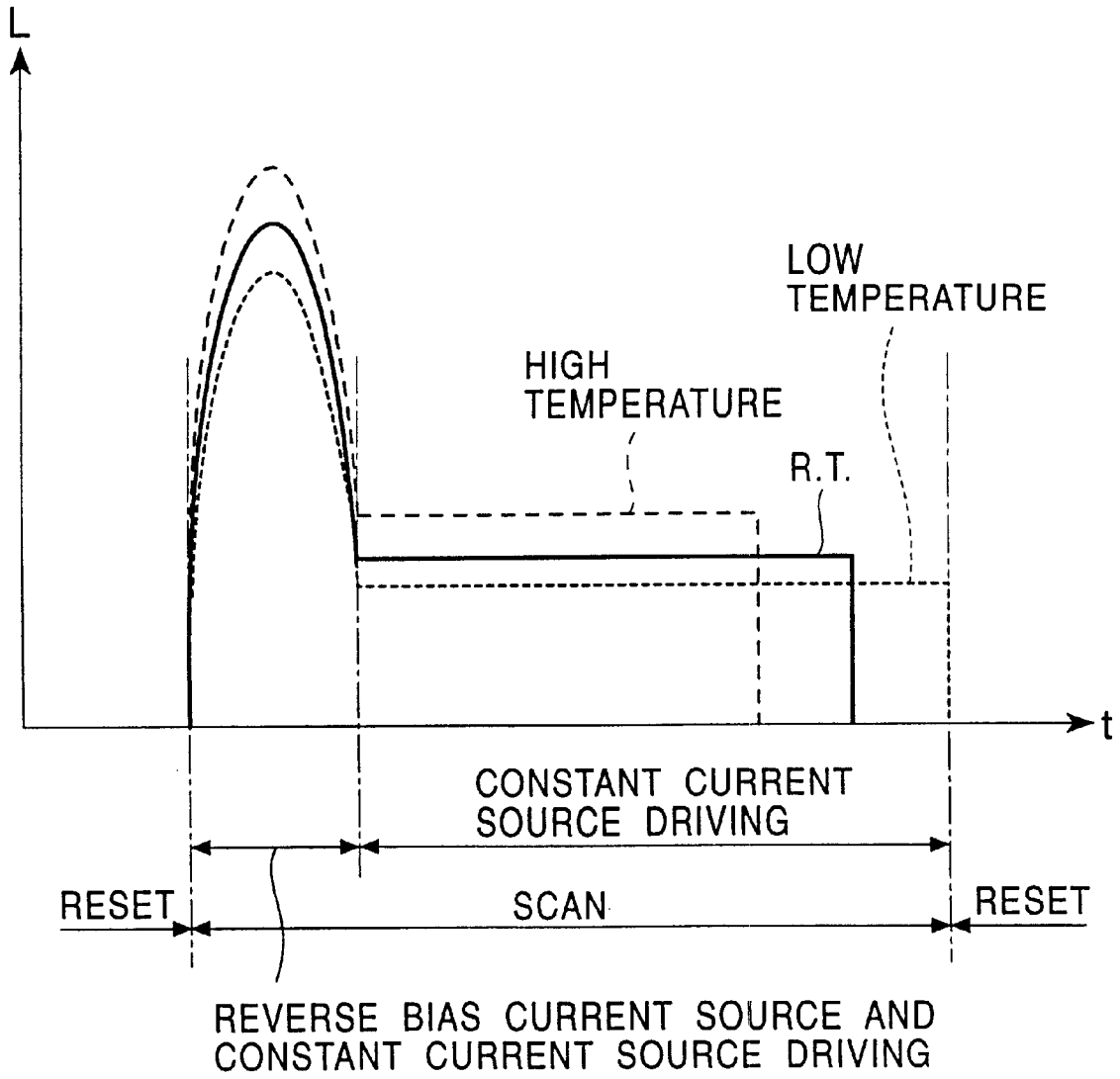
FIG. 18 is a time chart showing a change in light emission luminance of the EL device for explaining the temperature compensating operation of the driving apparatus of FIG. 17.

The relation between the area surrounded by the luminance curve and the time axis and the gradation based on the light emission control of the PWM mentioned above can be maintained to be constant by the temperature compensated driving current. FIG. 18 shows the details thereof.

According to FIG. 18, it will be understood that, in the preparing period, the light emission luminance of the EL device is low at a low temperature and high at a high temperature. The reverse bias voltage is held constant and the light emission luminance of the EL device depends on the temperature and changes in accordance with the applied voltage in the preparing period.

In the constant current source driving period, the light emission luminance of the EL device is low at a low temperature and high at a high temperature. A value of the driving current is held constant and the light emission luminance of the EL device depends on the temperature and changes in accordance with the driving current.

In the embodiment, the whole substantial light emission luminance in the scanning mode can be made constant by changing the driving pulse width in the constant current source driving period in accordance with the change in light emission luminance in the preparing period and constant current source driving period. In more detail, the pulse width of the driving pulse is narrowed so as to reduce the light emitting time in the constant current source driving period at a high temperature, and the pulse width of the driving pulse is increased so as to extend the light emitting time in the constant current source driving period at a low temperature. The change in pulse width is realized by a circuit in FIG. 17 using the thermistor in the driving circuit 2.

Although the control mode based on the reset driving method has been described in the above-mentioned embodiments, it can be also modified to a control mode based on an ordinary matrix driving method.

Although the mode of controlling the reverse bias voltage, the mode of controlling the value of the driving current, and the mode of controlling the supplying time of the driving current have been mentioned as embodiments for performing the temperature compensation in the description so far, a combination of them can be also properly applied.

Although the apparatus using the organic EL devices has been described in the embodiments, the present invention can be also applied to the other EL devices or devices which are substantially equivalent to them.

Further, although the thermistor (temperature sensitive semiconductor) has been mentioned as a temperature sensing device to realize the temperature sensing unit in each of the embodiments, the invention is not limited to the thermistor but the other devices and means which is capable of sensing a temperature change can be also applied. The user can properly manually adjust the value of the reverse bias voltage, current source characteristics, or the like in accordance with an external use environment of the apparatus without providing the temperature-sensing unit.

Although the various means or steps have been described limitedly in each of the embodiments, the present invention can be properly modified within the scope which can be designed by those skilled in the art.

As described in detail above, according to the present invention, the substantial light emission luminance characteristics can be held constant even if the environmental temperature fluctuates.

The preferred embodiments of the present invention have been made. It will be obviously understood that those skilled in the art can presume many modifications and variations. All of the modifications and variations are incorporated in the scope of claims of the invention.

What is claimed is:

1. A driving apparatus for EL devices, comprising:

a driving unit for selectively supplying a light emission driving energy to said EL devices;

a temperature sensing unit for sensing an operation temperature; and a temperature compensating unit for changing said light emission driving energy;

wherein said temperature compensating unit decreases said light emission driving energy in accordance with an increase in said operation temperature and increases said light emission driving energy in accordance with a decrease in said operation temperature;

wherein said driving unit comprises: a plurality of first electrode lines; a plurality of second electrode lines which intersect said first electrode lines; and a light emission control unit for selecting any of said first electrode lines every horizontal scanning period of an image signal that is supplied, selecting any of said second electrode lines in correspondence to a pixel position in said horizontal scanning period, applying a reverse bias voltage to portions between non-selected lines among said first electrode lines and non-selected lines among said second electrode lines, and supplying a driving current to portions between the selected electrode line among said first electrode lines and the selected electrode line among said second electrode lines, wherein said EL devices are arranged in a matrix form in which one of each of electrodes and another electrode are connected to one of said first electrode lines and one of said second electrode lines, respectively, and said temperature compensating unit changes a magnitude of said reverse bias voltage in accordance with said operation temperature.

2. An apparatus according to claim 1, wherein said light emission control unit has a resetting unit for performing a resetting operation to extract charges accumulated in said EL devices every said horizontal scanning period.

3. An apparatus according to claim 2, wherein said temperature compensating unit decreases a magnitude of said reverse bias voltage in accordance with an increase in said operation temperature and increases the magnitude of said reverse bias voltage in accordance with a decrease in said operation temperature.

4. An apparatus according to claim 1, wherein said temperature compensating unit decreases a magnitude of said reverse bias voltage in accordance with an increase in said operation temperature and increases the magnitude of said reverse bias voltage in accordance with a decrease in said operation temperature.

5. An apparatus according to claim 1, wherein said temperature compensating unit changes a magnitude of said driving current in accordance with said operation temperature.

6. An apparatus according to claim 5, wherein said light emission control unit has a resetting unit for performing a resetting operation to extract charges accumulated in said EL devices every said horizontal scanning period.

7. An apparatus according to claim 6, wherein said temperature compensating unit decreases a magnitude of said driving current in accordance with an increase in said operation temperature and increases the magnitude of said driving current in accordance with a decrease in said operation temperature.

8. An apparatus according to claim 5, wherein said temperature compensating unit decreases a magnitude of said driving current in accordance with an increase in said operation temperature and increases the magnitude of said driving current in accordance with a decrease in said operation temperature.

9. An apparatus according to claim 5, wherein said temperature sensing unit includes a thermistor.

10. An apparatus according to claim 1, wherein said temperature compensating unit changes the supplying period of time of said driving current in accordance with said operation temperature.

11. An apparatus according to claim 10, wherein said light emission control unit has a resetting unit for performing a resetting operation to extract charges accumulated in said EL devices every said horizontal scanning period.

12. An apparatus according to claim 10, wherein said temperature compensating unit decreases the driving period of time in accordance with an increase in said operation temperature and increases the driving period of time in accordance with a decrease in said operation temperature.

13. An apparatus according to claim 11, wherein said temperature compensating unit decreases the driving period of time in accordance with an increase in said operation temperature and increases the driving period of time in accordance with a decrease in said operation temperature.

14. An apparatus according to claim 10, wherein said temperature sensing unit includes a thermistor.

15. An apparatus according to claim 1, wherein said temperature sensing unit includes a thermistor.

16. A display apparatus, comprising:

a plurality of light-emitting devices respectively connected between a plurality of first electrode lines and a plurality of second electrode lines;

a driving circuit which selectively connects said first electrodes to connect a driving current;

a temperature detecting device which detects a temperature; and a temperature compensating unit which compensates said driving current to increase as said temperature decreases and to decrease as said temperature increases;

wherein said display includes a driving unit having a light emission control unit for selecting any of said first electrode lines every horizontal scanning period of an image signal that is supplied, selecting any of said second electrode lines in correspondence to a pixel position in said horizontal scanning period, applying a reverse bias voltage to portions between non-selected lines among said first electrode lines and non-selected lines among said second electrode lines, and supplying a driving current to portions between the selected electrode line among said first electrode lines and the selected electrode line among said second electrode lines, wherein said EL devices are arranged in a matrix form in which one of each of electrodes and another electrode are connected to one of said first electrode lines and one of said second electrode lines, respectively, and said temperature compensating unit changes a magnitude of said reverse bias voltage in accordance with said operation temperature.

17. The apparatus according to claim 16, wherein said driving current is a constant current during a horizontal scanning period.

18. The apparatus according to claim 16, wherein said driving circuit has a plurality of said temperature detecting devices that correspond to each of said first electrodes.

19. The apparatus according to claim 16, wherein said driving circuit has a plurality of said temperature compensating units that correspond to each of said first electrodes.

20. A display apparatus, comprising:

a plurality of light-emitting devices respectively connected between a plurality of first electrode lines and a plurality of second electrode lines;

a driving circuit which selectively connects said first electrodes to connect a driving current;

a temperature detecting device which detects a temperature; and a temperature compensating unit which compensates a period of applying said driving current based on said temperature, wherein said temperature compensating unit decreases said period as said temperature increases and increases said period as said temperature decreases.

21. The apparatus according to claim 20, wherein said driving current is a constant current during a horizontal scanning period.

22. The apparatus according to claim 20, wherein said driving circuit has a plurality of said temperature detecting devices that correspond to each of said first electrodes.

23. The apparatus according to claim 20, wherein said driving circuit has a plurality of said temperature compensating units that correspond to each of said first electrodes.

24. A display apparatus, comprising:

a plurality of light-emitting devices respectively connected between a plurality of first electrode lines and a plurality of second electrode lines;

a scanning circuit which selectively connects said second electrodes to connect selectively a first potential and a second potential;

a temperature detecting device which detects a temperature;

a temperature compensating unit which compensates said first potential based on said temperature;

wherein said display includes a driving unit having: a light emission control unit for selecting any of said first electrode lines every horizontal scanning period of an image signal that is supplied, selecting any of said second electrode lines in correspondence to a pixel position in said horizontal scanning period, applying a reverse bias voltage to portions between non-selected lines among said first electrode lines and non-selected lines among said second electrode lines, and supplying a driving current to portions between the selected electrode line among said first electrode lines and the selected electrode line among said second electrode lines, wherein said EL devices are arranged in a matrix form in which one of each of electrodes and another electrode are connected to one of said first electrode lines and one of said second electrode lines, respectively, and said temperature compensating unit changes a magnitude of said reverse bias voltage in accordance with said operation temperature.

25. The apparatus according to claim 24, wherein said temperature compensating unit increases said first potential as said temperature decreases and decreases said first potential as said temperature increases.

26. The apparatus according to claim 24, wherein said scanning circuit has a plurality of said temperature detecting devices that correspond to each of second electrodes.

27. The apparatus according to claim 24, wherein said scanning circuit has a plurality of said temperature compensating units that correspond to each of said second electrodes.

28.The apparatus according to claim 24, wherein, during a scan period, said scanning circuit connects one of said second electrodes to said second potential and the others to said first potential.

29. The apparatus according to claim 24, wherein said first potential is a reverse voltage.

30. The apparatus according to claim 24, wherein said second potential is a ground potential.

31. A method for compensating a light emission driving energy to a EL device, comprising;

(a) sensing an operation temperature;

(b) changing said light emission driving energy to decrease in accordance with an increase in said operation temperature and to increase in accordance with a decrease in said operation temperature; and (c) supplying said light emission driving energy to said EL device;

wherein said display comprises a driving unit having: a plurality of first electrode lines; a plurality of second electrode lines which intersect said first electrode lines; and a light emission control unit for selecting any of said first electrode lines every horizontal scanning period of an image signal that is supplied, selecting any of said second electrode lines in correspondence to a pixel position in said horizontal scanning period, applying a reverse bias voltage to portions between non-selected lines among said first electrode lines and non-selected lines among said second electrode lines, and supplying a driving current to portions between the selected electrode line among said first electrode lines and the selected electrode line among said second electrode lines, wherein said EL devices are arranged in a matrix form in which one of each of electrodes and another electrode are connected to one of said first electrode lines and one of said second electrode lines, respectively, and said temperature compensating unit changes a magnitude of said reverse bias voltage in accordance with said operation temperature.

32. A method for driving a display in which light-emitting devices are selectively connected to first electrodes and second electrodes, comprising;

(a) detecting a temperature;

(b) compensating a driving current, which is to be supplied to said first electrodes, to increase as said temperature decreases and to decrease as said temperature increases;

(c) supplying said driving current to said first electrodes;

wherein said display comprises a driving unit having: a plurality of first electrode lines; a plurality of second electrode lines which intersect said first electrode lines; and a light emission control unit for selecting any of said first electrode lines every horizontal scanning period of an image signal that is supplied, selecting any of said second electrode lines in correspondence to a pixel position in said horizontal scanning period, applying a reverse bias voltage to portions between non-selected lines among said first electrode lines and non-selected lines among said second electrode lines, and supplying a driving current to portions between the selected electrode line among said first electrode lines and the selected electrode line among said second electrode lines, wherein said EL devices are arranged in a matrix form in which one of each of electrodes and another electrode are connected to one of said first electrode lines and one of said second electrode lines, respectively, and said temperature compensating unit changes a magnitude of said reverse bias voltage in accordance with said operation temperature.

33. A method for driving a display in which light-emitting devices are selectively connected to first electrodes and second electrodes, comprising:

(a) detecting a temperature;

(b) compensating a period for applying a driving current which is to be supplied to said first electrodes, based on said temperature; and (c) supplying said driving current to said first electrodes during said period, wherein said operation (b) comprises:

(b1) decreasing said period as said temperature increases, and (b2) increasing said period as said temperature decreases.

34. A method for driving a display in which light-emitting devices are selectively connected to first electrodes and second electrodes, comprising;

(a) detecting a temperature;

(b) compensating a first potential, which is to be applied to said second electrodes, based on said temperature; and (c) applying said first potential to said second electrodes during said period;

wherein said display comprises a driving unit having: a plurality of first electrode lines; a plurality of second electrode lines which intersect said first electrode lines; and a light emission control unit for selecting any of said first electrode lines every horizontal scanning period of an image signal that is supplied, selecting any of said second electrode lines in correspondence to a pixel position in said horizontal scanning period, applying a reverse bias voltage to portions between non-selected lines among said first electrode lines and non-selected lines among said second electrode lines, and supplying a driving current to portions between the selected electrode line among said first electrode lines and the selected electrode line among said second electrode lines, wherein said EL devices are arranged in a matrix form in which one of each of electrodes and another electrode are connected to one of said first electrode lines and one of said second electrode lines, respectively, and said temperature compensating unit changes a magnitude of said reverse bias voltage in accordance with said operation temperature.

35. The method according to claim 34, wherein said operation (b) comprises:

(b1) decreasing said first potential as said temperature increases, and (b2) increasing said first potential as said temperature decreases.

36. The method according to claim 34, wherein said operation (c) comprises;

(c1) applying a second potential to one of said second electrodes, and (c2) applying said first potential to the other of said second electrodes.

* * * * *